US008500232B2

(12) United States Patent
Suh

(10) Patent No.: US 8,500,232 B2
(45) Date of Patent: Aug. 6, 2013

(54) HEAD CHIP FOR INK JET TYPE IMAGE FORMING APPARATUS

(75) Inventor: Jun Woo Suh, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 274 days.

(21) Appl. No.: 12/472,617

(22) Filed: May 27, 2009

(65) Prior Publication Data

US 2010/0013887 A1 Jan. 21, 2010

(30) Foreign Application Priority Data

Jul. 17, 2008 (KR) ..... 10-2008-0069466

(51) Int. Cl.

| | |
|---|---|
| ***B41J 29/377*** | (2006.01) |
| *B41J 29/38* | (2006.01) |
| *B41J 2/015* | (2006.01) |
| *B41J 2/165* | (2006.01) |
| *B41J 2/34* | (2006.01) |
| *B41J 2/335* | (2006.01) |

(52) U.S. Cl.
USPC ..... 347/18; 347/9; 347/20; 347/26; 347/207

(58) Field of Classification Search
USPC ..... 347/18, 26, 207
See application file for complete search history.

(56) References Cited

U.S. PATENT DOCUMENTS

| | | | | |
|---|---|---|---|---|
| 5,017,941 | A * | 5/1991 | Drake | 347/67 |
| 5,818,485 | A * | 10/1998 | Rezanka | 347/89 |
| 5,876,187 | A * | 3/1999 | Forster et al. | 417/322 |
| 5,992,963 | A * | 11/1999 | Miyake et al. | 347/18 |
| 6,283,718 | B1 * | 9/2001 | Prosperetti et al. | 417/52 |
| 6,331,050 | B1 * | 12/2001 | Nakata et al. | 347/65 |
| 6,343,857 | B1 * | 2/2002 | Cowger | 347/89 |
| 6,591,625 | B1 * | 7/2003 | Simon | 62/259.2 |
| 6,607,259 | B2 * | 8/2003 | Mott et al. | 347/18 |
| 6,926,391 | B2 * | 8/2005 | Yang et al. | 347/65 |
| 7,168,778 | B2 * | 1/2007 | Baxter | 347/18 |
| 7,325,310 | B2 * | 2/2008 | Kim | 29/890.1 |
| 7,334,630 | B2 * | 2/2008 | Goodson et al. | 165/104.33 |
| 7,364,684 | B2 * | 4/2008 | Brandenburg et al. | 264/272.13 |
| 7,449,816 | B2 * | 11/2008 | Sugahara | 310/324 |
| 7,585,059 | B2 * | 9/2009 | Sagara et al. | 347/68 |
| 8,201,924 | B2 * | 6/2012 | Xie et al. | 347/65 |
| 8,235,505 | B2 * | 8/2012 | Xie et al. | 347/54 |
| 8,382,231 | B2 * | 2/2013 | Takano et al. | 347/18 |
| 2002/0081866 | A1 * | 6/2002 | Choi et al. | 438/800 |
| 2003/0085307 | A1 * | 5/2003 | Okuda et al. | 239/548 |
| 2004/0080568 | A1 * | 4/2004 | Matsuo et al. | 347/40 |
| 2005/0133101 | A1 * | 6/2005 | Chung et al. | 137/833 |
| 2006/0023436 | A1 * | 2/2006 | Sugahara | 361/760 |
| 2007/0008378 | A1 * | 1/2007 | Kanda | 347/54 |
| 2009/0051724 | A1 * | 2/2009 | Katoh | 347/18 |
| 2009/0085950 | A1 * | 4/2009 | Takata | 347/18 |

FOREIGN PATENT DOCUMENTS

| | | |
|---|---|---|
| JP | 2006-199021 | 8/2006 |
| WO | WO 2008139949 A1 * | 11/2008 |

* cited by examiner

*Primary Examiner* — Laura Martin
*Assistant Examiner* — Jeremy Bishop
(74) *Attorney, Agent, or Firm* — Stanzione & Kim, LLP

(57) ABSTRACT

A head chip for an ink jet type image forming apparatus with an improved cooling structure is disclosed. The head chip includes a plurality of nozzles to eject ink, a plurality of heaters for ink ejection to apply heat to ink so that the ink is ejected through the plurality of nozzles, and a cooling channel to circulate a refrigerant around the plurality of heaters for ink ejection.

24 Claims, 21 Drawing Sheets

HEAD CHIP FOR INK JET TYPE IMAGE FORMING APPARATUS

CROSS-REFERENCE TO RELATED APPLICATIONS

This application claims the benefit of Korean Patent Application No. 2008-0069466, filed on Jul. 17, 2008 in the Korean Intellectual Property Office, the disclosure of which is incorporated herein by reference in its entirety.

BACKGROUND OF THE INVENTION

1. Field of the Invention

The present general inventive concept relates to a head chip for an ink jet type image forming apparatus, and, more particularly, to a head chip with an improved cooling structure.

2. Description of the Related Art

An ink jet type image forming apparatus refers to an apparatus to form an image by ejecting fine ink droplets onto a desired position on a printing medium. Such an ink jet type image forming apparatus is generally classified as an electro-thermal type and a piezoelectric type. The electro-thermal type ink jet image forming apparatus generates bubbles in the ink using a heat source provided at a head chip, and ejects ink droplets through nozzles formed at the head chip using expansive power at the moment of generation of the bubbles.

A head chip for an ink jet type image forming apparatus includes a substrate configured as a silicon wafer and formed with an ink supply port, a channel forming layer disposed on the substrate to form a channel and ink chambers, and a nozzle layer disposed on the channel forming layer and formed with nozzles corresponding to the ink chambers. A substrate layer in contact with the channel forming layer is provided with heaters for ink ejection to form bubbles by heating ink stored in the ink chambers.

Recently, a distance between the nozzles and a firing pulse rate applied to the heaters for ink ejection have been gradually increased, in order to achieve an image of high quality and an increase in printing speed. Accordingly, a problem of adequately maintaining a temperature of the head chip becomes critical. If a distance between the nozzles and a firing pulse applied to the heaters for ink ejection are gradually increased, energy accumulated in the head chip is increased, which causes temperature rise of the head chip. As a result, properties of the ink may be changed, and printing quality may be deteriorated.

A conventional ink jet type image forming apparatus is constituted such that heat is dissipated through a metal head chip, or a head chip is cooled down by attaching an additional cooling member to the head chip. However, dissipating heat through a head chip is inefficient, and attaching an additional cooling member to a head chip reduces productivity and space efficiency.

SUMMARY OF THE INVENTION

The present general inventive concept provides a head chip for an ink jet type image forming apparatus with an improved cooling structure.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing a head chip for an ink jet type image forming apparatus including: a plurality of nozzles to eject ink, a plurality of heaters for ink ejection to apply heat to ink so that the ink is ejected through the plurality of nozzles, and a cooling channel to circulate a refrigerant around the plurality of heaters for ink ejection.

The head chip may further include at least one pumping part to forcibly circulate the refrigerant. The at least one pumping part may be provided in the cooling channel.

Each of the at least one pumping part may include a hot spot to form bubbles by applying heat to the refrigerant.

The hot spot may include a heater for refrigerant flow.

The hot spot may be heated by the heaters for ink ejection.

Each of the at least one pumping part may further include a flow resistance portion to apply flow resistance to the refrigerant.

The flow resistance portion may be provided downstream of flow from the hot spot.

The flow resistance portion may be provided on the hot spot.

The flow resistance portion may be formed in an orifice shape.

The flow resistance portion may include a crooked channel.

Flow resistance applied to a refrigerant passing through the flow resistance portion in a direction opposite to a refrigerant circulation direction may be larger than flow resistance applied to a refrigerant passing through the flow resistance portion in the refrigerant circulation direction.

The head chip may further include ink chambers to store ink to be ejected to the nozzles so that the ink is heated by the heaters for ink ejection. The cooling channel may include a supply channel to be supplied with the refrigerant, a circulation channel provided adjacent to the heaters for ink ejection to circulate the refrigerant supplied through the supply channel therethrough, and a discharge channel to discharge the refrigerant passing through the circulation channel. The circulation channel may be formed in the same layer as the ink chambers.

The cooling channel may include a plurality of pumping parts.

The refrigerant may be ink stored in an ink storage unit.

The cooling channel may be formed integrally with the head chip.

In accordance with another aspect of the present general inventive concept, there is provided a head chip for an ink jet type image forming apparatus including: a plurality of ink ejection parts to eject ink through nozzles by heating the ink; and a cooling channel to forcibly circulate a refrigerant around the ink ejection parts so as to prevent overheating of the ink ejection parts.

The head chip may further include at least one pumping part to form bubbles by heating the refrigerant in the cooling channel, and to form flow resistance so that the refrigerant flows in one direction while the bubbles are contracted.

In accordance with another aspect of the present general inventive concept, there is provided a cartridge for an ink jet type image forming apparatus including an ink storage unit and a head chip seated in the ink storage unit, the head chip including: a plurality of nozzles to eject ink supplied from the ink storage unit; a plurality of heaters for ink ejection to apply heat to ink so that the ink is ejected through the plurality of nozzles; and a cooling channel to circulate a refrigerant around the plurality of heaters for ink ejection.

The cartridge may further include at least one pumping part provided in the cooling channel to forcibly circulate the refrigerant.

Each of the at least one pumping part may include a hot spot and a flow resistance portion provided downstream of flow of the hot spot.

In accordance with a further aspect of the present general inventive concept, there is provided a method of manufacturing a head chip for an ink jet type image forming apparatus, the method including: preparing a substrate; forming a heater in a first surface of the substrate to heat ink; forming a channel forming layer defining an ink channel and a circulation channel in the first surface of the substrate; and forming a nozzle layer having nozzles on the channel forming layer.

The method may further include forming a supply channel and a discharge channel in the substrate, the supply channel and the discharge channel being in contact with the circulation channel.

The method may further include forming at least one pumping part to forcibly circulate a refrigerant through the circulation channel.

In accordance with another aspect of the present general inventive concept, there is provided an image forming apparatus that may include a feeding unit to feed a printing medium, and an image forming unit to form an image on the printing medium using a cartridge with a head chip, wherein the head chip may include: a plurality of nozzles to eject ink, a plurality of heaters for ink ejection to apply heat to ink so that the ink is ejected through the plurality of nozzles, and a cooling channel to circulate a refrigerant around the plurality of heaters for ink ejection.

In accordance with another aspect of the present general inventive concept, there is provided a cartridge usable with an image forming apparatus that may include an ink storage unit to store ink, and a head chip attached to a portion of the ink storage unit, wherein the head chip may include: a plurality of nozzles to eject ink, a plurality of heaters for ink ejection to apply heat to ink so that the ink is ejected through the plurality of nozzles, and a cooling channel to circulate a refrigerant around the plurality of heaters for ink ejection.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
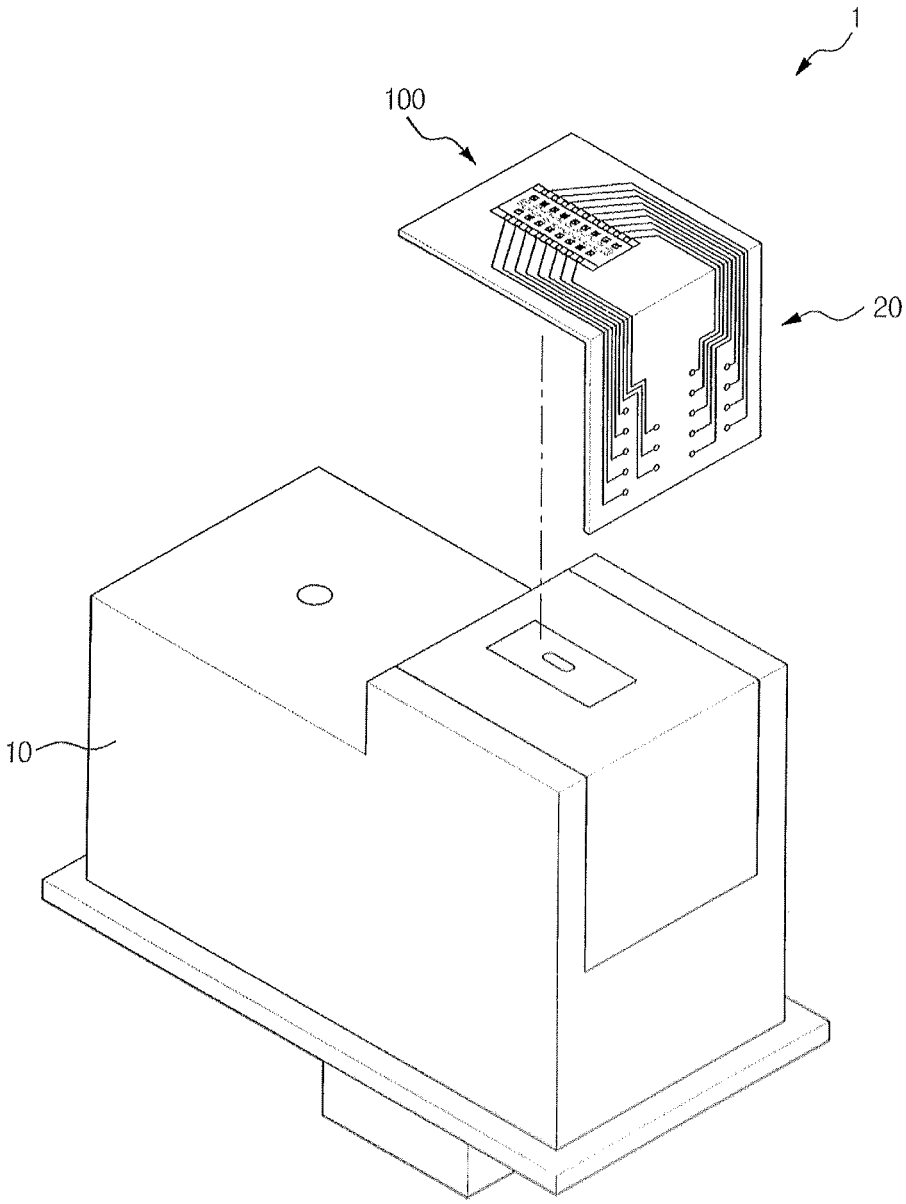
FIG. 1 is a perspective view illustrating a cartridge of an ink jet type image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below to explain the present general inventive concept by referring to the figures.

FIG. 1 is a perspective view illustrating a cartridge for an ink jet type image forming apparatus according to an embodiment of the present general inventive concept.

A cartridge 1 of this embodiment may include an ink storage unit 10 to store ink therein, a head chip 100 seated in the ink storage unit 10 to eject ink, and a printed circuit board 20 having circuits and signal lines to drive the head chip 100.

Figure 2:
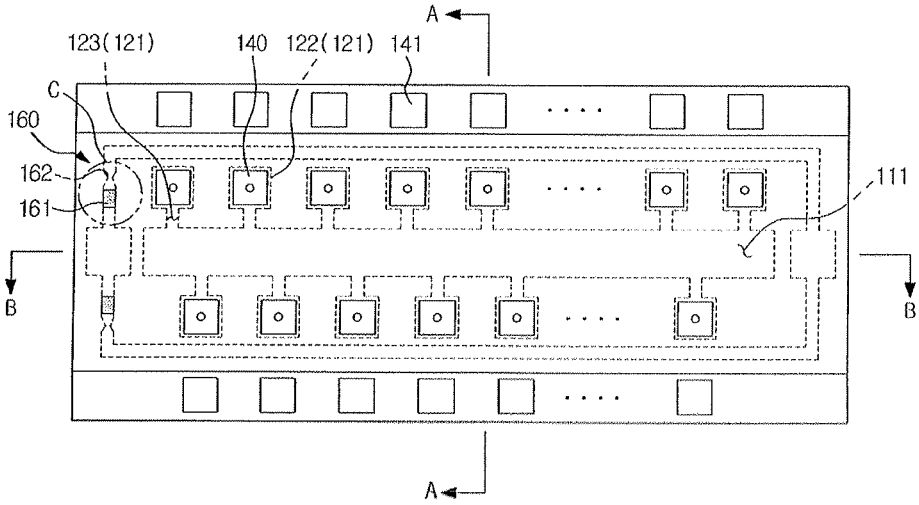
FIG. 2 is a plan view illustrating a constitution of a head chip according to an embodiment of the present general inventive concept.
Figure 3:
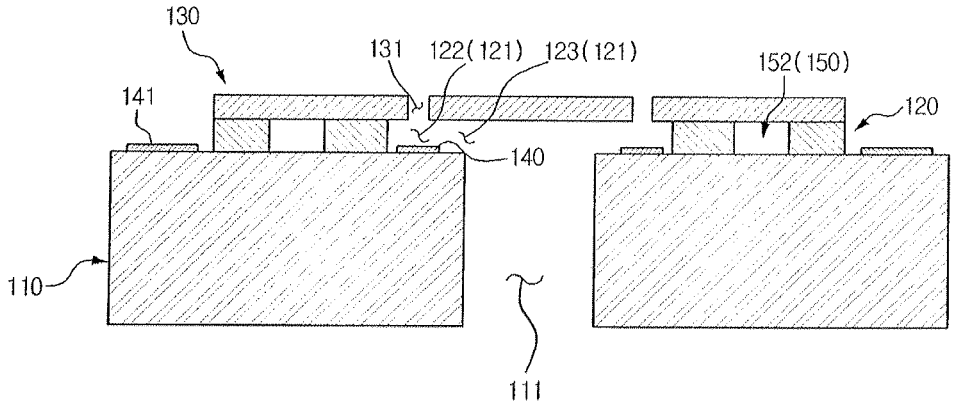
FIG. 3 is a sectional view taken along line A-A of FIG. 2.
Figure 4:
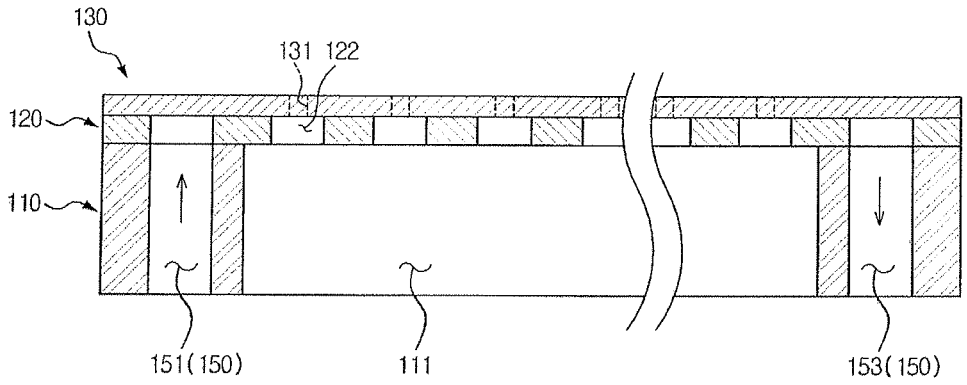
FIG. 4 is a sectional view taken along line B-B of FIG. 2.

FIG. 2 is a plan view illustrating a constitution of the head chip according to an embodiment of the present general inventive concept, FIG. 3 is a sectional view taken along line A-A of FIG. 2, and FIG. 4 is a sectional view taken along line B-B of FIG. 2

As shown in the drawings, the head chip 100 may include a substrate 110, a channel forming layer 120 disposed on the substrate 110 to form ink channels 121, a nozzle layer 130 disposed on the channel forming layer 120 and having nozzles 131 to eject ink therethrough, and heaters 140 for ink ejection to apply heat to ink so that the ink is ejected through the nozzles 131 of the nozzle layer 130.

The substrate 110 may be formed with an ink supply port 111 for ink supply. The ink supply port 111 extends in a longitudinal direction of the head chip 100.

The channel forming layer 120 may define the ink channels 121 to connect the ink supply port 111 and the nozzles 131. Each of the ink channels 121 includes an ink chamber 122 filled with ink, and a restrictor 123 to connect the ink supply port 111 and the ink chamber 122.

The nozzle layer 130 may be formed with the plurality of nozzles 131 to eject ink from the ink chambers 122 therethrough.

Each of the heaters 140 for ink ejection is provided at a portion of each of the ink chambers 122. The heaters 140 for ink ejection receive energy through electrodes 141, and instantaneously apply heat to the ink temporarily stored in the ink chambers 122. At the moment of heat application, explosive bubbles are generated in the ink, and a portion of the ink in the ink chambers 122 is ejected outside the head chip 100 through the nozzles 131 by the explosive bubbles. At this time, a portion of the energy generated from the heaters 140 for ink ejection is used in the ink ejection. Another portion of the energy is discharged outside the head chip 100 together with the ejected ink. However, a large amount of thermal energy is accumulated in the head chip 100.

In order to effectively dissipate the heat accumulated in the head chip 100, the head chip 100 may further include a cooling channel 150 to circulate the ink around the plurality of heaters 140 for ink ejection, and pumping parts 160 provided in the cooling channel 150 to forcibly circulate the ink.

In this embodiment, the ink stored in the ink storage unit 10 is used as a refrigerant, however a separate fluid may be used as a refrigerant.

The cooling channel 150 may include a supply channel 151 to be supplied with ink, a circulation channel 152 provided adjacent to the heaters 140 for ink ejection to circulate the ink supplied from the supply channel 151 therethrough, and a discharge channel 153 to discharge the ink passing through the circulation channel 152.

The supply channel 151 and the discharge channel 153 may be formed integrally with the substrate 110 so as to come in contact with the ink storage unit 10, and the circulation channel 152 may be formed integrally with the channel forming layer 120. The cooling channel 150 may be formed by an etching process.

Therefore, the head chip 100 for an ink jet type image forming apparatus of this embodiment has an effect such that the heat accumulated in the head chip 100 is actively discharged by heat exchange with a refrigerant circulating through the cooling channel 150, thereby adequately maintaining a temperature of the head chip 100.

The head chip 100 for an ink jet type image forming apparatus of this embodiment also has an effect such that the cooling channel 150 is formed integrally with the head chip 100 without attaching a separate cooling member to the head chip 100, thereby improving productivity of the head chip 100 and space efficiency.

Figure 5A:
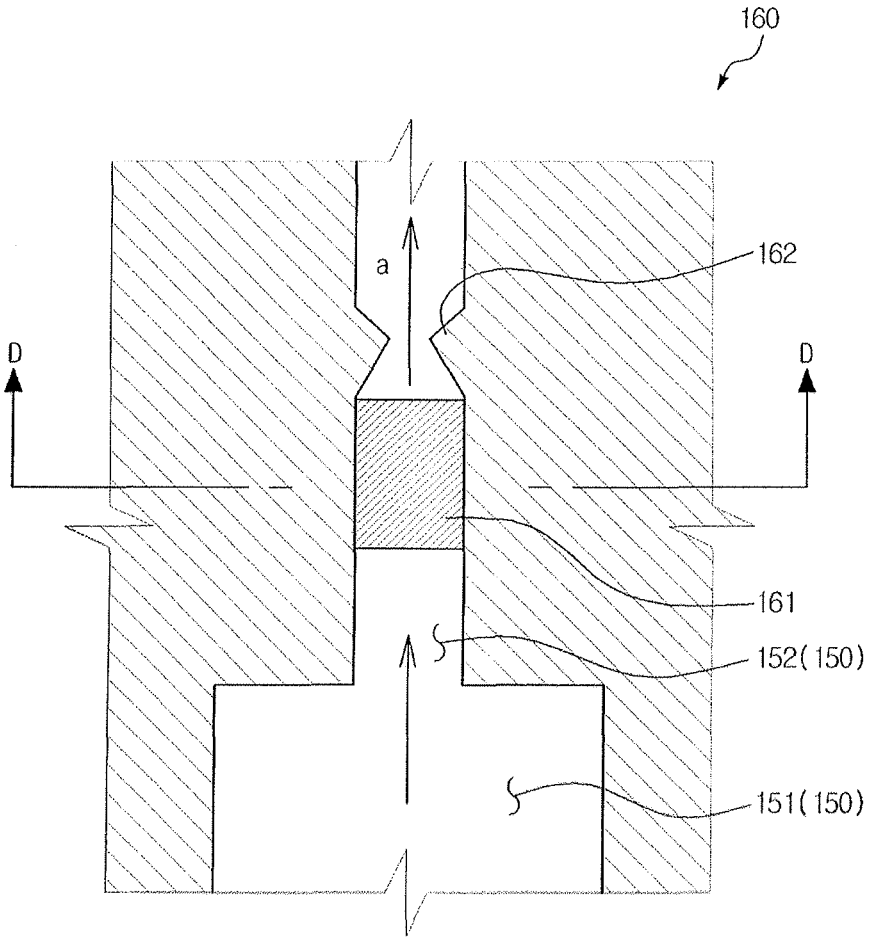
FIG. 5A is an enlarged plan view of a C portion of FIG. 2.
Figure 5B:
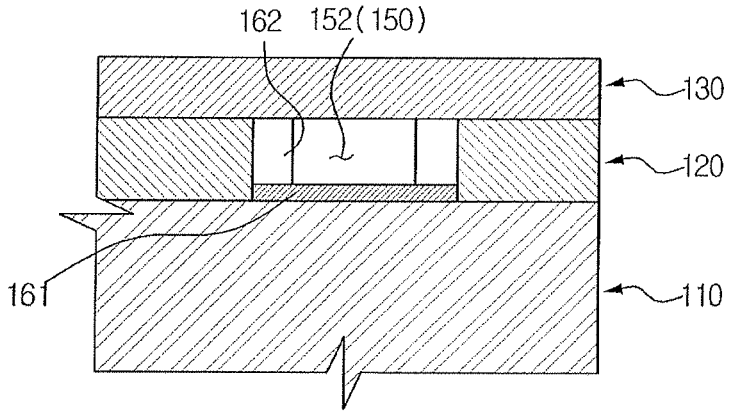
FIG. 5B is a sectional view taken along line D-D of FIG. 5A.

FIG. 5A is an enlarged plan view of a C portion of FIG. 2, and FIG. 5B is a sectional view taken along line D-D of FIG. 5A. A pumping part of this embodiment will be explained with reference to the drawings.

Each of the pumping parts 160 may include a hot spot 161 and a flow resistance portion 162 provided downstream of flow from the hot spot.

The hot spot 161 serves to form explosive bubbles by instantaneously applying heat to the ink in the cooling channel 150. The hot spot 161 of this embodiment is configured as a heater for refrigerant flow provided in the cooling channel 150.

As shown in the drawings, the flow resistance portion 162 is formed in an orifice shape. The flow resistance portion 162 may be formed such that a cross-section reduction rate of the channel per unit channel length in an "a" direction is smaller than a cross-section reduction rate of the channel per unit channel length in a "b" direction. Here, the "a" direction refers to a refrigerant circulation direction, and the "b" direction refers to a direction that is the opposite of the refrigerant circulation direction.

Therefore, there is a greater flow resistance for a refrigerant that flows in a direction from the flow resistance portion 162 to the hot spot 161 than a refrigerant that flows in a direction from the hot spot 161 to the flow resistance portion 162. In other words, the flow resistance of the refrigerant passing through the flow resistance portion in the direction that is the opposite of the refrigerant circulation direction is larger than the flow resistance of the refrigerant passing through the flow resistance portion in the refrigerant circulation direction. Accordingly, when the generated bubbles are contracted, as illustrated in FIG. 5*d*, the bubbles receive the relatively strong flow resistance in the "b" direction, and thus portions of the bubbles adjacent to the flow resistance portion 162 are primarily contracted.

Figure 5C:
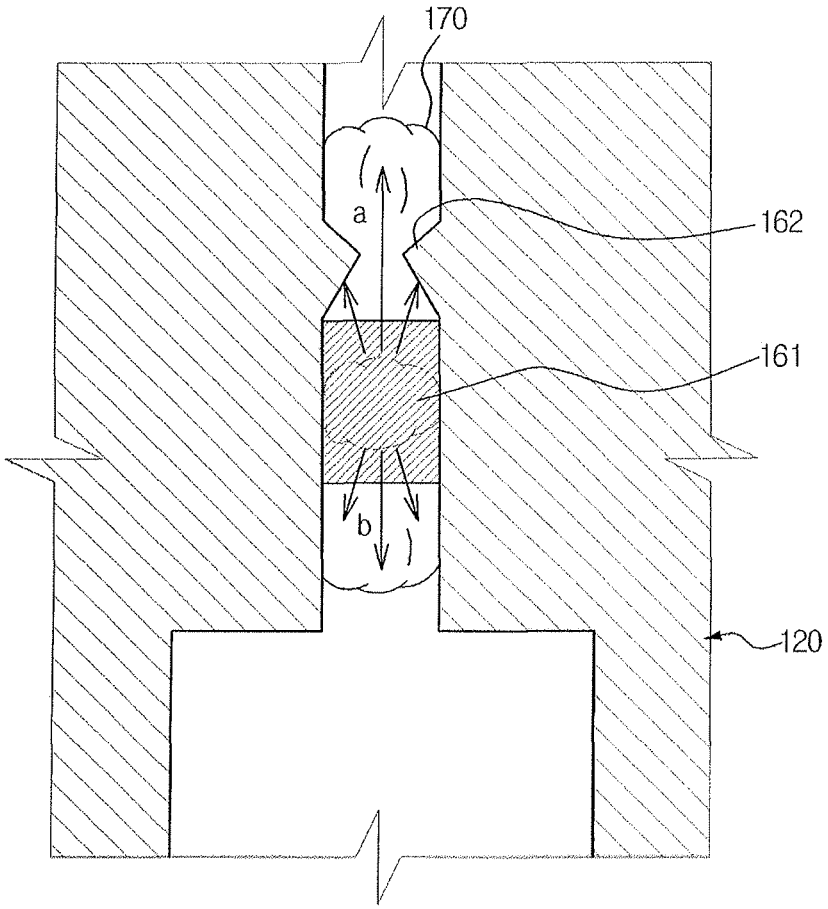
FIGS. 5C and 5D are plan views illustrating operation of a pumping part according to an embodiment of the present invention.
Figure 5D:
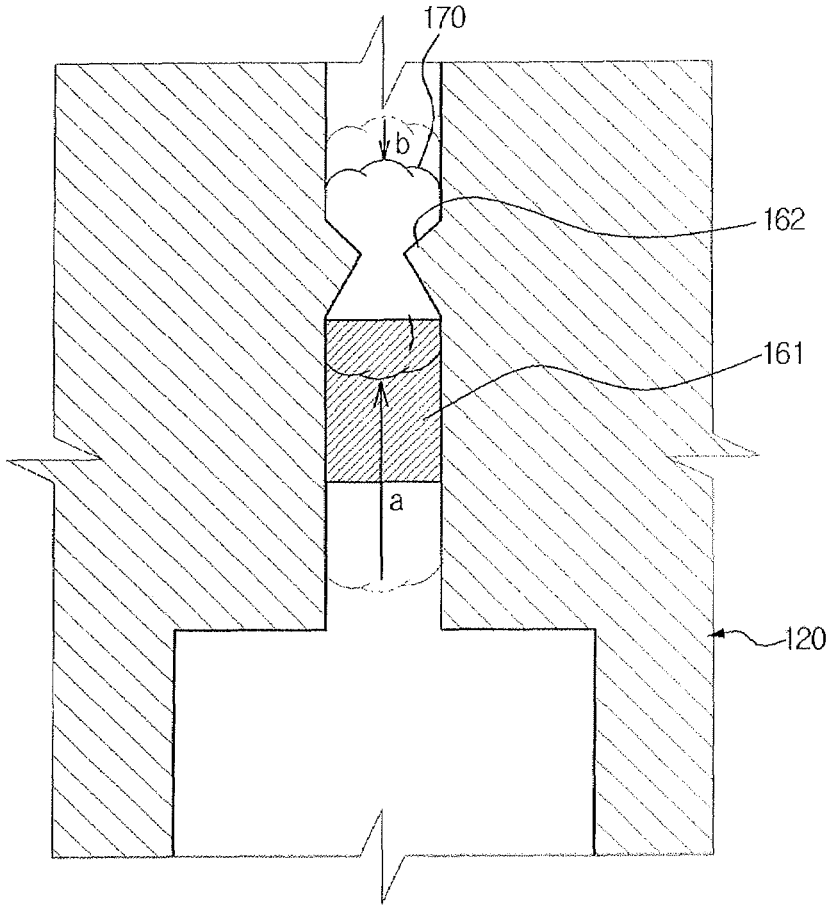

FIGS. 5C and 5D are plan views illustrating operation of a pumping part according to an embodiment of the present general inventive concept. A flow forming process will be explained with reference to the drawings.

As described above, the ink in the cooling channel 150 is instantaneously heated by the hot spots 161 for refrigerant flow. At this time, explosive bubbles 170 are generated (refer to FIG. 5C), and then the bubbles 170 are contracted (refer to FIG. 5D). In the contraction process, because the bubbles 170 interfere with the flow resistance portion 162, the bubbles are not contracted toward the hot spot 161 of the center of explosion, i.e., the heater for refrigerant flow, but are contracted in the "a" direction. Accordingly, the ink moves in the "a" direction. In other words, the flow in the "a" direction is formed in such a manner that the ink is pushed in the "a" direction when the bubbles are generated, and the fluid is pulled in the "a" direction when the bubbles are contracted, thereby circulating the ink in the "a" direction.

Therefore, since the ink can be forcibly circulated in the cooling channel 150 of a considerably small size, the head chip 100 of this embodiment has an effect such that space efficiency and productivity are further improved.

FIGS. 6A to 6H are views for illustrating a method of manufacturing the head chip for an ink jet type image forming apparatus according to the present general inventive concept.

Figure 6A:
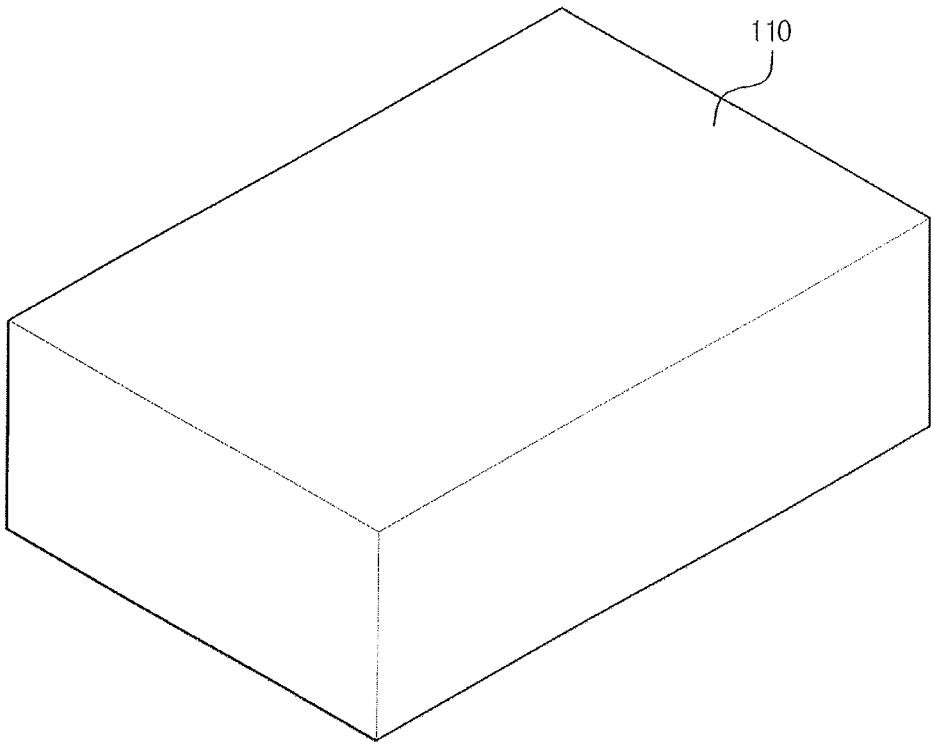
FIGS. 6A to 6H are views for illustrating a method of manufacturing the head chip for an ink jet type image forming apparatus according to the present general inventive concept.
Figure 6B:
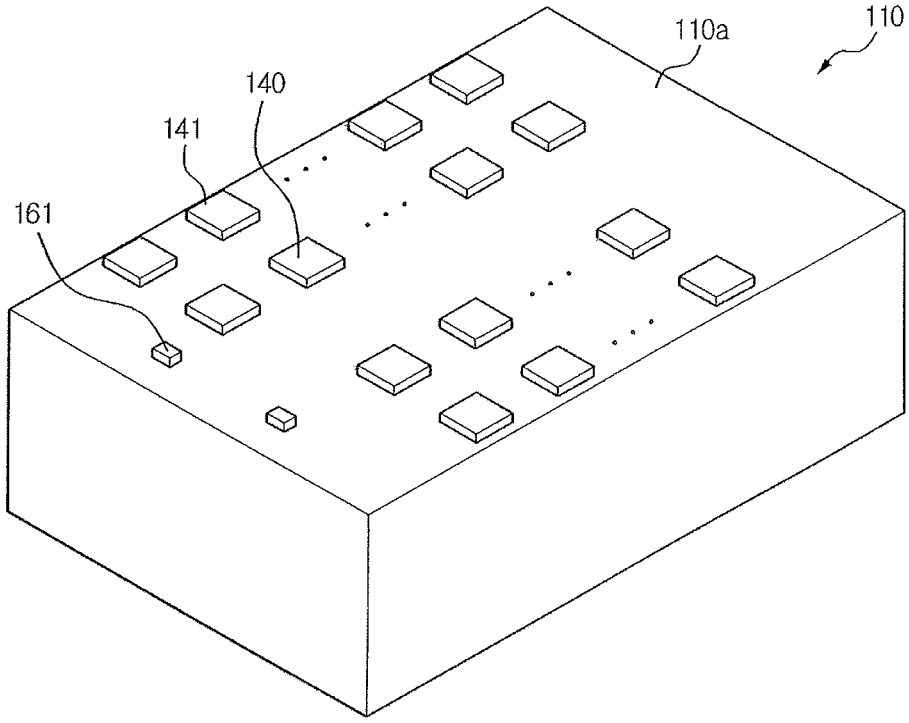

As shown in FIGS. 6A and 6B, a wafer may be prepared as the substrate 110. The heaters 140 for ink ejection, the hot spots 161 for refrigerant flow and the electrodes 141 are formed in a first surface 110*a* of the substrate 110.

The heaters 140 for ink ejection and the hot spots 161 for refrigerant flow may be formed by depositing a resistance heating material on the substrate 110 by sputtering or chemical vapor deposition, and by patterning the same. The resistance heating material may include, but is not limited to, tantalum-nitride, tantalum aluminum alloy, and the like.

The electrodes 141 may be formed by depositing a metal material having good conductivity by sputtering, and by patterning the same. The metal material having good conductivity may include, but is not limited to, aluminum. A protective layer (not shown) may be provided on the heaters 140, the hot spots 161 and the electrodes 141. The protective layer may be configured as a silicon oxide membrane, a silicon nitride membrane, and the like.

The electrodes 141, the heaters 140, and the hot spots 161 may be wired so as to be electrically connected.

Figure 6C:
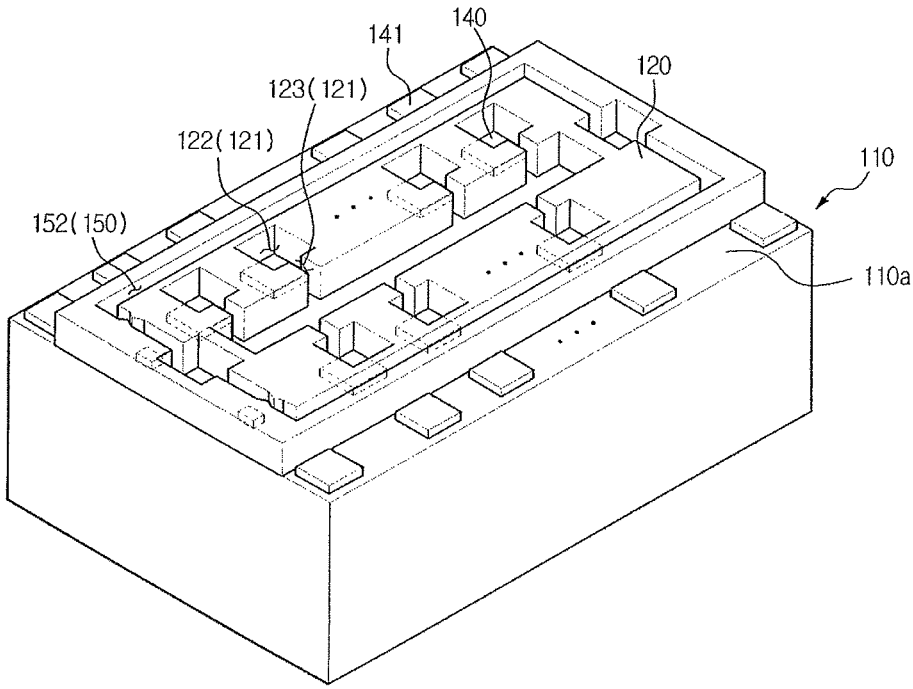

As shown in FIG. 6C, the channel forming layer 120 may be formed on the substrate 110 formed with the heaters 140 and the electrodes 141 by a photolithography process. Although not illustrated in the drawings, such a process may include a process of coating a negative photoresist on the substrate 110 by a spin coating method, a process of exposing the photoresist layer by using a photomask formed with patterns of the circulation channel, the ink chambers and the restrictors, and a process of forming the channel forming layer 120 defining the ink channels 121 and the circulation channel 152 by developing the photoresist layer and removing non-exposed portions of the photoresist layer. At this time, the flow resistance portion 162 is formed in the circulation channel 152.

Figure 6D:
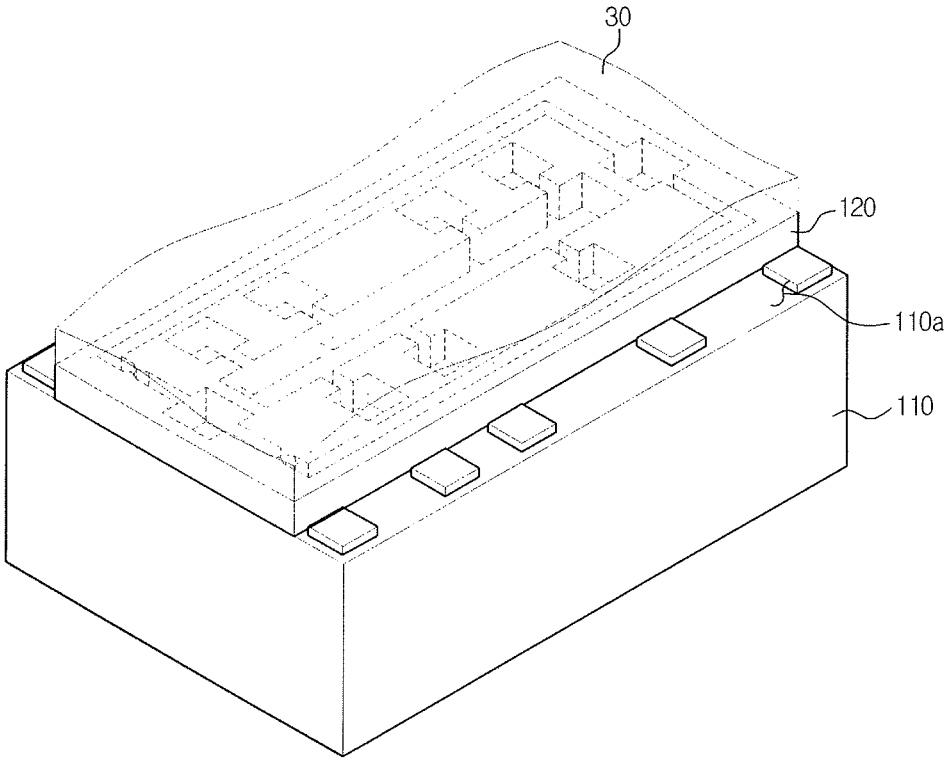

As shown in FIG. 6D, a sacrificial layer 30 is formed to cover the first surface 110*a* of the substrate 110 and the channel forming layer 120. The sacrificial layer 30 may be formed by coating a positive photoresist by a spin coating method. When the substrate 110 is etched in order to form the ink supply port 111, the supply channel 151 and the discharge channel 153, the sacrificial layer 30 is exposed to an etchant. Thus, the sacrificial layer 30 may be made of a material having strong resistance to an etchant.

Figure 6E:
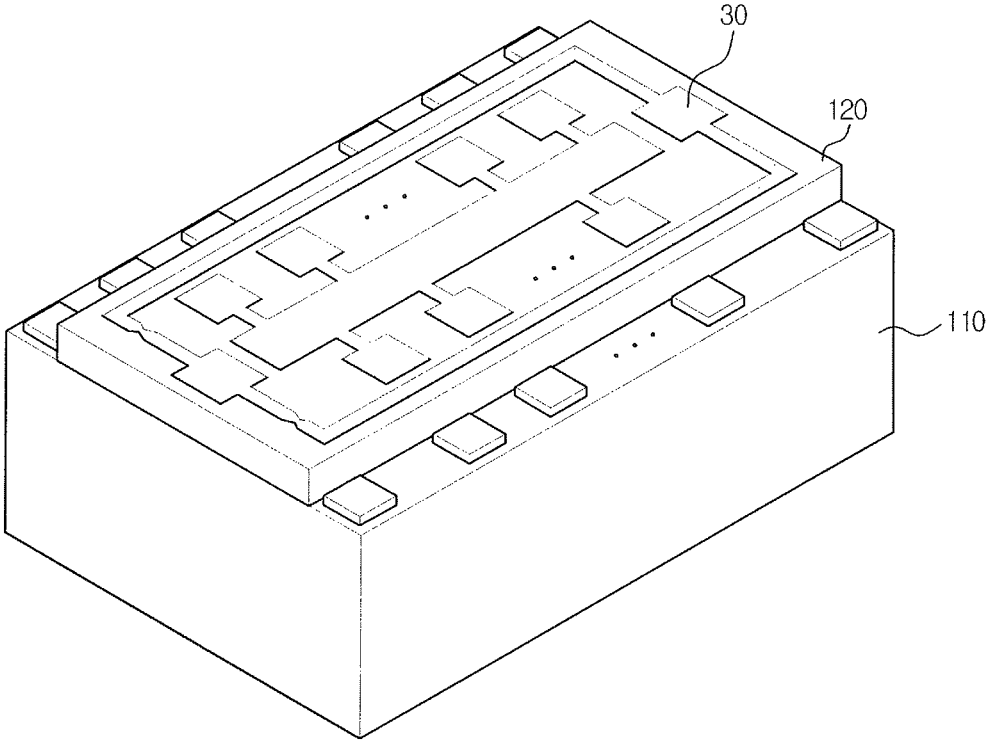

As shown in FIG. 6E, top surfaces of the sacrificial layer 30 and the channel forming layer 120 are flattened through a chemical mechanical polish (CMP) process so that the channel forming layer 120 and the sacrificial layer 30 have the same height. Such a flattening process permits the nozzle layer 130 formed on the channel forming layer 120 to be in close contact with the channel forming layer 120. Therefore, the durability of the print head can be improved. Further, the shape and dimensions of the ink channel can be accurately controlled; thus ink ejection performance of the print head can be improved.

Figure 6F:
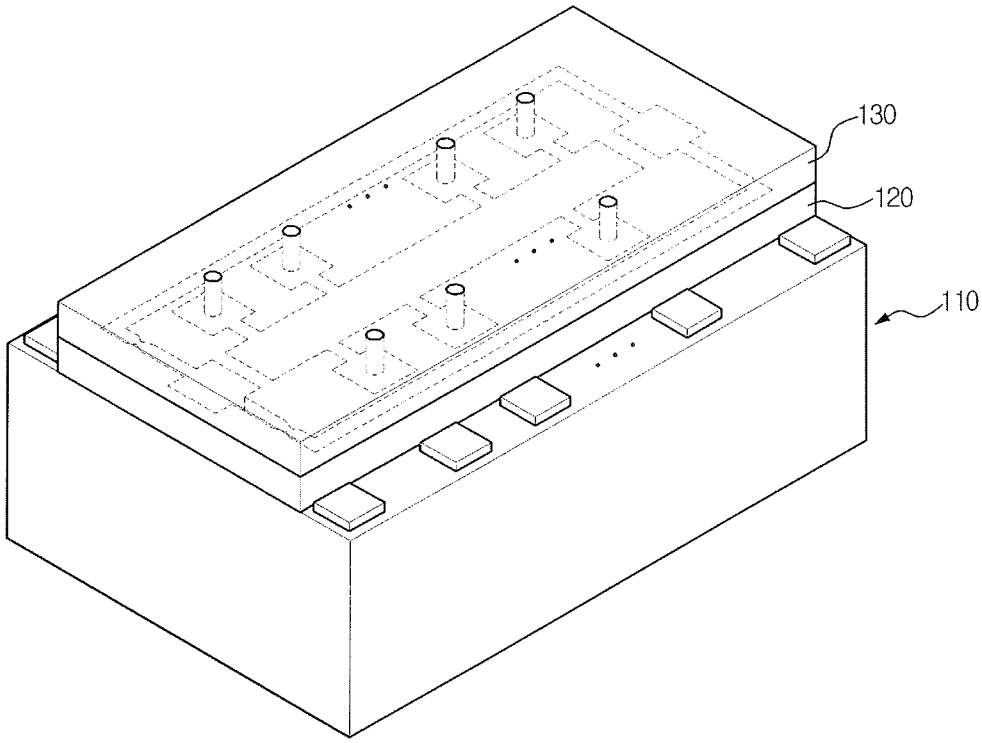

As shown in FIG. 6F, the nozzle layer 130 is formed on the flattened sacrificial layer 30 and channel forming layer 120. The nozzle layer 130 may be formed by a photolithography process. In other words, a photoresist is coated on the channel forming layer 120, and the photoresist is exposed through a photomask formed with a nozzle pattern, and then is developed to remove non-exposed portions of the photoresist. As a result, as shown in FIG. 6F, the nozzle layer 130 with the nozzles 31 is achieved.

Figure 6G:
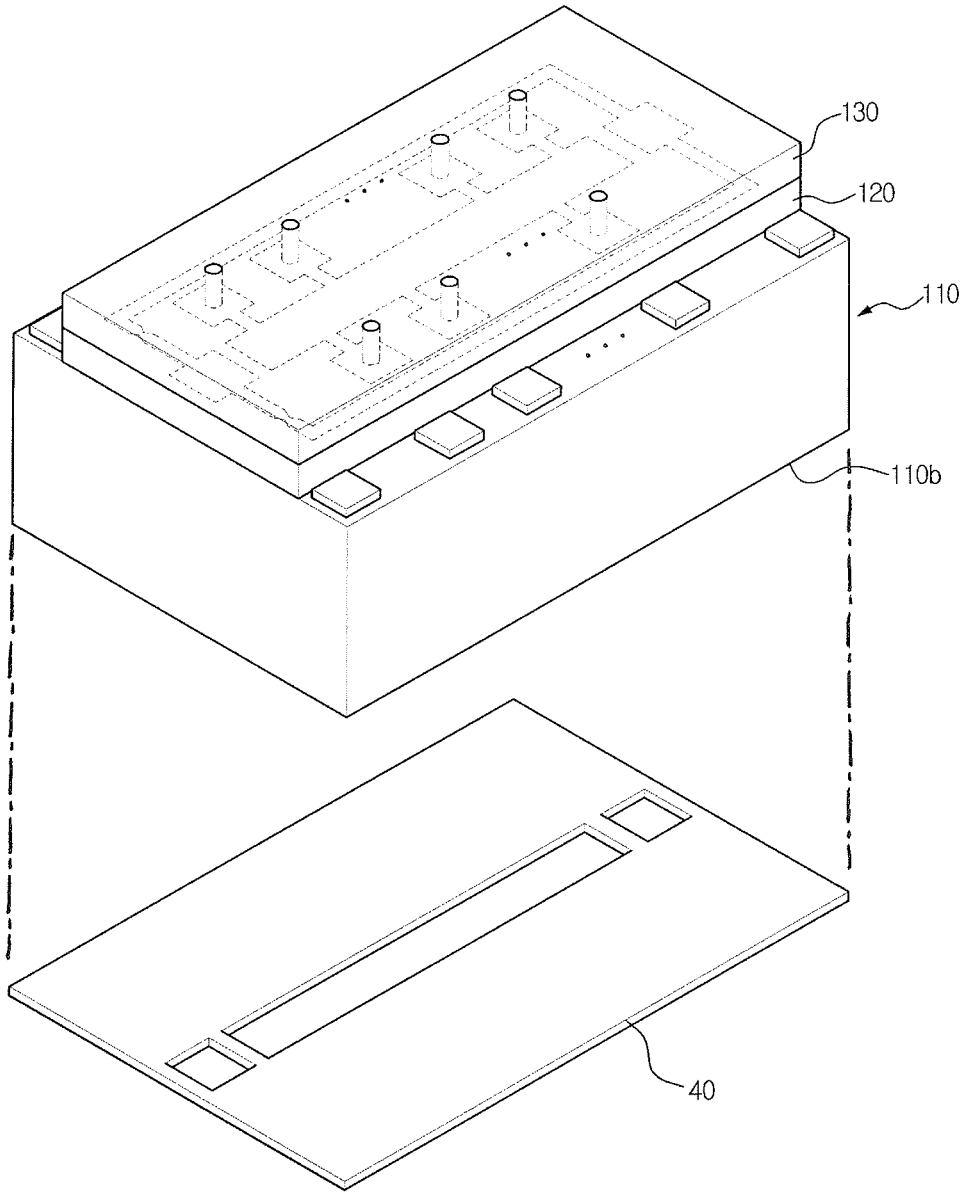

As shown in FIG. 6G, an etching mask 40 is formed on a second surface 110*b* of the substrate 110 to form the ink supply port 111 (refer to FIG. 3), the supply channel 151 (refer to FIG. 4) and the circulation channel 153 (refer to FIG. 4). The etching mask 40 may be formed by coating a positive or negative photoresist on the second surface 110*b* of the substrate 110 and by patterning the same.

After the etching mask 40 is formed, the product shown in FIG. 6G is immersed in an etchant to etch the substrate 110 so that the substrate 110 is penetrated from the second surface 110*b* of the substrate 110 exposed by the etching mask 40.

Figure 6H:
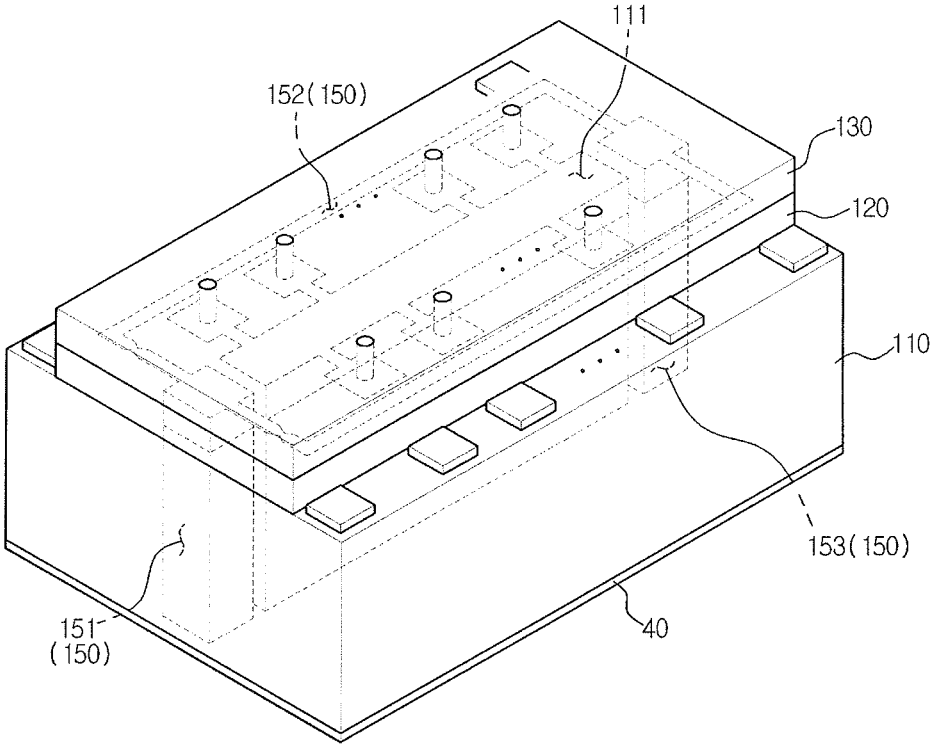

Accordingly, as shown in FIG. 6H, the ink supply port 111, the supply channel 151 and the discharge channel 153 are formed.

Finally, the etching mask 40 and the sacrificial layer 30 are removed from the state shown in FIG. 6H. As a result, the head chip of this embodiment as shown in FIG. 3 is achieved.

Hereinafter, modified embodiments of the present general inventive concept will be explained. The explanation of the same components as the components of an embodiment will be omitted.

Figure 7:
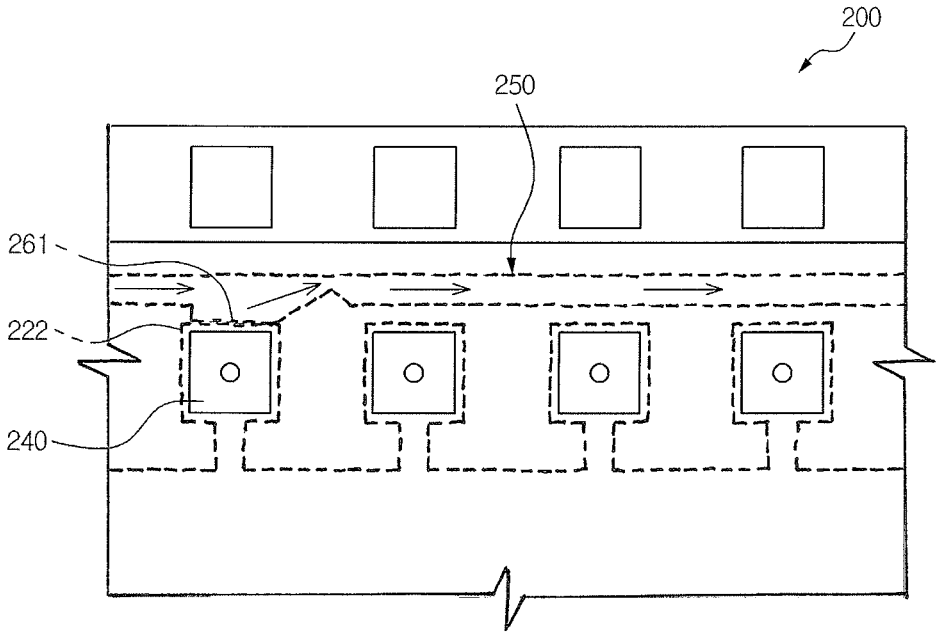
FIG. 7 is a plan view illustrating a pumping part according to an embodiment of the present general inventive concept.

FIG. 7 is a plan view illustrating a pumping part according to an embodiment of the present general inventive concept. A hot spot 261 of a head chip 200 according to this embodiment is heated by a heater 240 for ink ejection. For this, a cooling channel 250 of this embodiment is formed such that at least a portion of the cooling channel 250 comes close to the heater 240 for ink ejection.

Therefore, in the head chip 200, the flow can be generated without a separate heater for ink flow. Specifically, explosive bubbles are formed in ink chambers 222 by the instantaneous heat generated from the heater 240 for ink ejection. At the same time, explosive bubbles are also formed in the cooling channel 250, so that the flow in the cooling channel 250 is generated.

Figure 8:
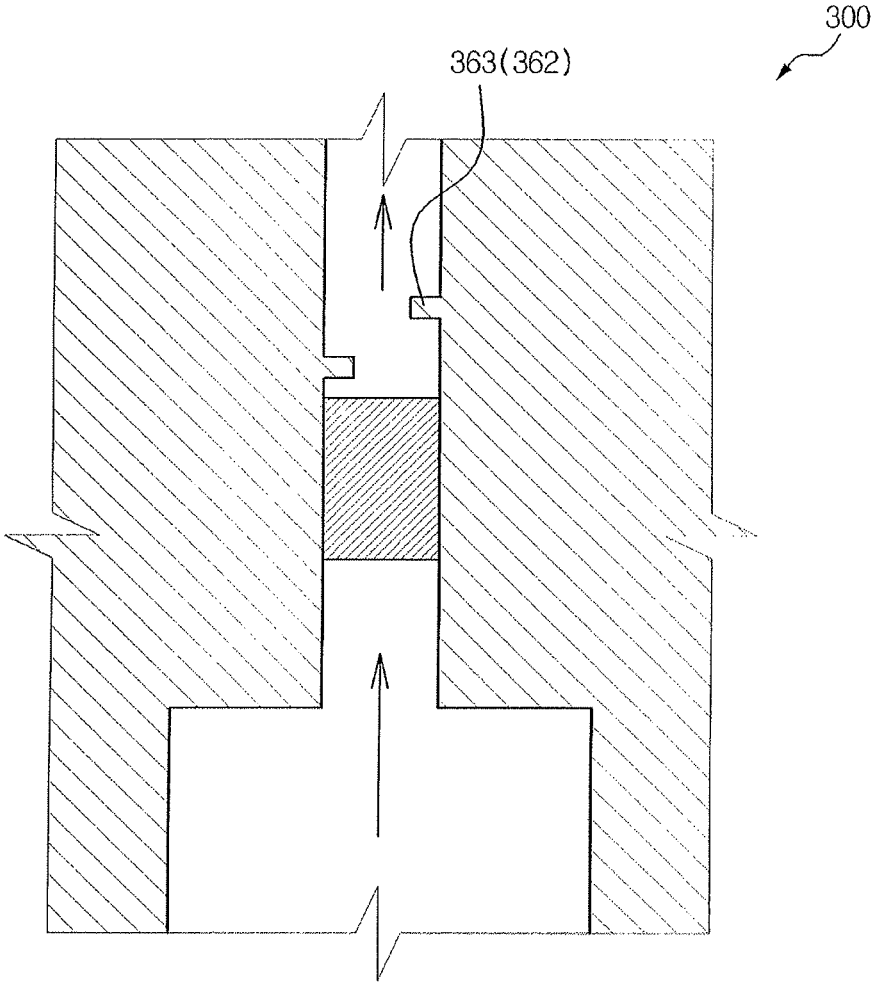
FIG. 8 is a plan view illustrating a pumping part according to an embodiment of the present general inventive concept, which corresponds to FIG. 5A.

FIG. 8 is a plan view illustrating a pumping part according to an embodiment of the present general inventive concept, which corresponds to FIG. 5A. A flow resistance portion 362 of a head chip 300 includes a crooked channel 363.

As illustrated in this embodiment, the flow resistance portion of the present general inventive concept serves to generate flow resistance, and can be modified in various ways.

Figure 9:
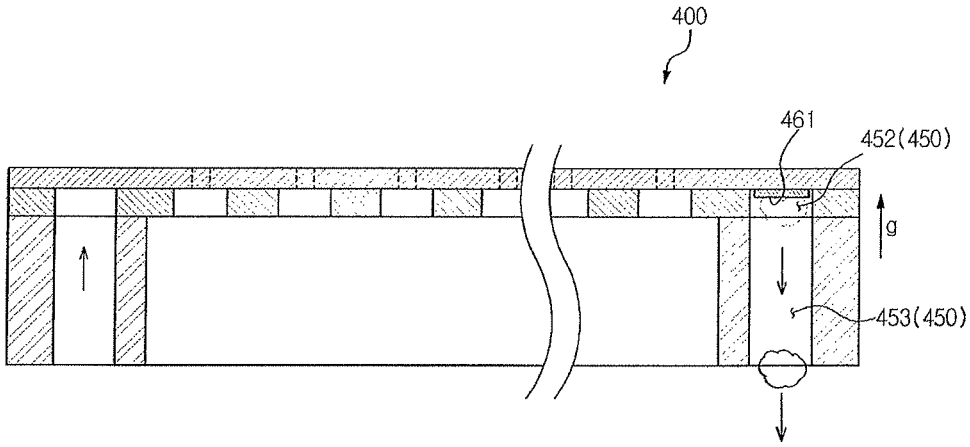
FIG. 9 is a sectional view illustrating a pumping part according to an embodiment of the present general inventive concept, which corresponds to FIG. 4.

FIG. 9 is a sectional view illustrating a pumping part according to an embodiment of the present general inventive concept, which corresponds to FIG. 4. A hot spot 461 of a head chip 400 is provided such that the generated explosive bubbles can move in a direction opposite to the gravity direction "g". Accordingly, the flow in the cooling channel 450 can be generated by buoyancy exerted on the bubbles without a flow resistance portion.

The hot spot 461 of this embodiment is provided near a connecting portion of a circulation channel 452 and a discharge channel 453. The hot spot 461 may be provided in the middle of the discharge channel 453. Also, if the bubbles are generated and can be discharged through the cooling channel 450 by buoyancy, there is no limitation in the position of the hot spot 461.

Figure 10:
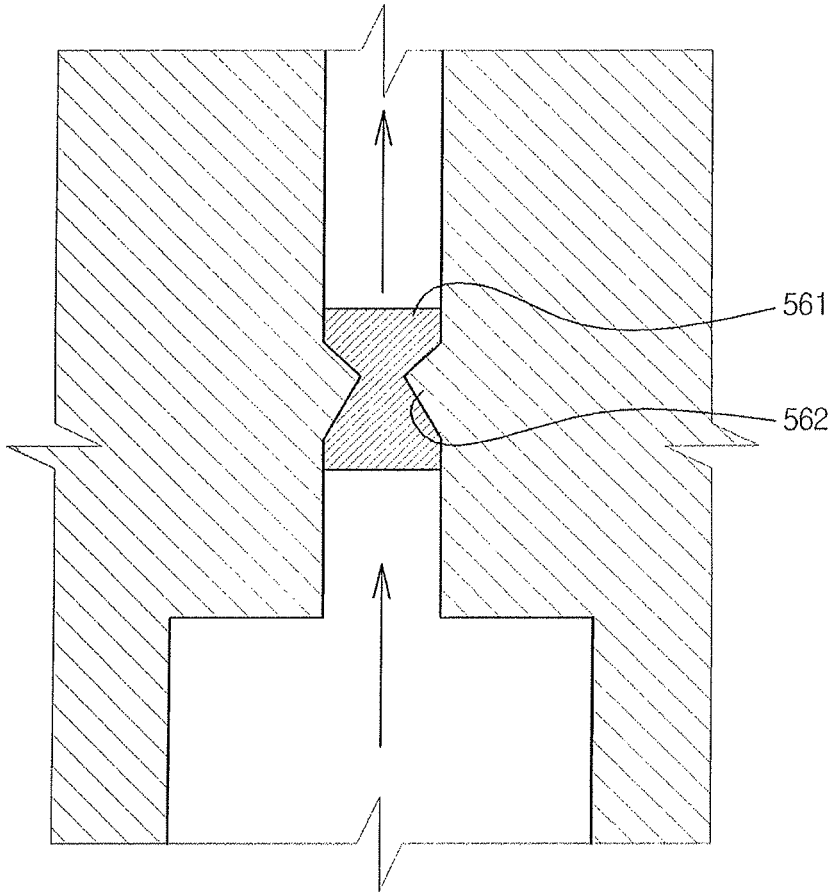
FIG. 10 is a view illustrating a pumping part according to an embodiment of the present general inventive concept, which corresponds to FIG. 5A.

FIG. 10 is a view corresponding to FIG. 5A. As illustrated in this embodiment, a flow resistance portion 562 can be positioned on a hot spot 561.

The above-described embodiments are illustrative, and changes may be made in these embodiments.

For example, the number of the pumping parts provided in the cooling channel may be two or more, and the different embodiments described in the above description may be employed at the same time.

Figure 11:
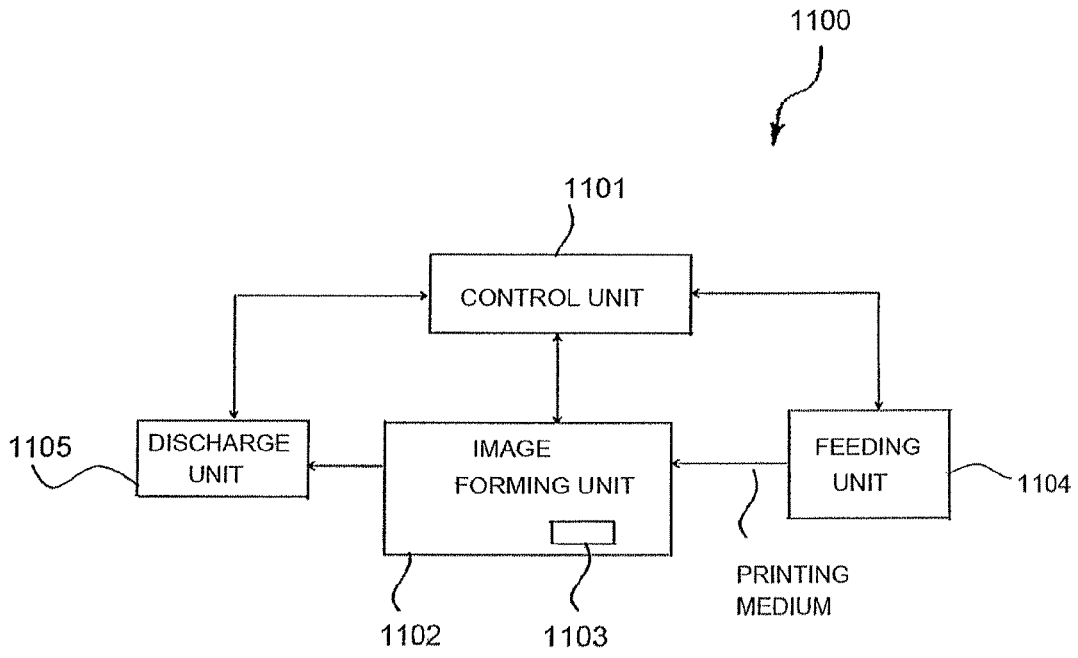
FIG. 11 is a view illustrating an image forming apparatus according to an embodiment of the present general inventive concept.

FIG. 11 is a view illustrating an image forming apparatus 1100 according to an embodiment of the present general inventive concept.

The image forming apparatus 1100 of this embodiment may include a control unit 1101, a feeding unit 1104, a discharge unit 1105, and an image forming unit 1102.

The control unit 1101 may control the feeding unit 1104, the image forming unit 1102, and the discharge unit 1105 to perform an image forming operation. For example, the control unit 1101 may control the feeding unit 1104 to feed a printing medium from the feeding unit 1104 to the image forming unit 1102. The control unit 1101 may then control the image forming unit 1102 to form an image on the printing medium. The control unit 1101 may then control the image forming unit 1102 to feed the printing medium to the discharge unit 1105. The control unit may then control the discharge unit 1105 to discharge the printing medium.

The image forming unit 1102 may include a cartridge 1103, which corresponds to cartridge 1 of FIG. 1. As illustrated with regard to FIG. 1, the cartridge 1103 may include an ink storage unit 10 to store ink therein, a head chip 100 seated in the ink storage unit 10 to eject ink, and a printed circuit board 20 having circuits and signal lines to drive the head chip 100.

Although the present general inventive concept has been explained with reference to a head driving type printer in the above description, a cooling structure of the present general inventive concept can also be applied to an array type printer.

As is apparent from the above description, the head chip for an ink jet type image forming apparatus according to the present general inventive concept has competitive productivity, and also has improved cooling efficiency and space efficiency.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. A head chip for an ink jet type image forming apparatus comprising:

a substrate having an ink supply port for ink supply;

a plurality of nozzles to eject ink;

a channel forming layer disposed on the substrate to form ink channels between the ink supply port and the nozzles;

a plurality of heaters for ink ejection provided in the ink channels to apply heat to ink so that the ink is ejected through the plurality of nozzles; and a closed-loop cooling channel integrally formed in the head chip and having at least one pumping part to circulate a refrigerant through a supply channel, a first circulation channel, a second circulation channel, and a discharge channel, the first and second circulation channels being formed in the head chip adjacent to and around the plurality of heaters for ink ejection, the first and second circulation channels and a portion of the supply channel and the discharge channel being formed in the channel forming layer, and another portion of the supply channel and the discharge channel being formed in the substrate.

2. The head chip for an ink jet type image forming apparatus according to claim 1, further comprising:

the at least one pumping part to forcibly circulate the refrigerant, the at least one pumping part being provided in the cooling channel.

3. The head chip for an ink jet type image forming apparatus according to claim 2, wherein each of the at least one pumping part includes a hot spot to form bubbles by applying heat to the refrigerant.

4. The head chip for an ink jet type image forming apparatus according to claim 3, wherein the hot spot includes a heater for refrigerant flow.

5. The head chip for an ink jet type image forming apparatus according to claim 1, wherein the hot spot is heated by the heaters for ink ejection.

6. The head chip for an ink jet type image forming apparatus according to claim 3, wherein each of the at least one pumping part further includes a flow resistance portion to apply flow resistance to the refrigerant.

7. The head chip for an ink jet type image forming apparatus according to claim 6, wherein the flow resistance portion is provided downstream of flow from the hot spot.

8. The head chip for an ink jet type image forming apparatus according to claim 6, wherein the flow resistance portion is provided on the hot spot.

9. The head chip for an ink jet type image forming apparatus according to claim 6, wherein the flow resistance portion is formed in an orifice shape.

10. The head chip for an ink jet type image forming apparatus according to claim 6, wherein the flow resistance portion includes a crooked channel.

11. The head chip for an ink jet type image forming apparatus according to claim 6, wherein flow resistance applied to a refrigerant passing through the flow resistance portion in a direction opposite to a refrigerant circulation direction is larger than flow resistance applied to a refrigerant passing through the flow resistance portion in the refrigerant circulation direction.

12. The head chip for an ink jet type image forming apparatus according to claim 1, wherein the channel forming layer includes ink chambers to store ink to be ejected to the nozzles so that the ink is heated by the heaters for ink ejection, wherein the cooling channel includes:

the supply channel to be supplied with the refrigerant, the first and second circulation channels provided adjacent to the heaters for ink ejection to circulate the refrigerant supplied through the supply channel therethrough, the first and second circulation channels being formed in the same layer as the ink chambers, and the discharge channel to discharge the refrigerant passing through the first and second circulation channels.

13. The head chip for an ink jet type image forming apparatus according to claim 1, wherein the cooling channel includes a plurality of pumping parts.

14. The head chip for an ink jet type image forming apparatus according to claim 1, wherein the refrigerant is ink stored in an ink storage unit.

15. A head chip for an ink jet type image forming apparatus including a plurality of ink ejection parts to eject ink through nozzles by heating the ink, the head chip comprising:

a substrate having an ink supply port for ink supply;

a channel forming layer disposed on the substrate to form ink channels between the ink supply port and a plurality of nozzles;

a closed-loop cooling channel integrally formed in the head chip and having at least one pumping part to forcibly circulate a refrigerant around the ink ejection parts and through a supply channel, a first circulation channel, a second circulation channel, and a discharge channel formed in the head chip adjacent to and around a plurality of heaters for ink ejection, the first and second circulation channels and a portion of the supply channel and the discharge channel being formed in the channel forming layer, and another portion of the supply channel and the discharge channel being formed in the substrate so as to prevent overheating of the ink ejection parts.

16. The head chip for an ink jet type image forming apparatus according to claim 15, further comprising:

the at least one pumping part to form bubbles by heating the refrigerant in the cooling channel, and to form flow resistance so that the refrigerant flows in one direction while the bubbles are contracted.

17. A cartridge for an ink jet type image forming apparatus including an ink storage unit and a head chip seated in the ink storage unit, wherein the head chip includes:

a substrate having an ink supply port for ink supply;

a plurality of nozzles to eject ink supplied from the ink storage unit;

a channel forming layer disposed on the substrate to form ink channels between the ink supply port and the nozzles;

a plurality of heaters for ink ejection provided at the ink channels to apply heat to ink so that the ink is ejected through the plurality of nozzles; and a closed-loop cooling channel integrally formed in the head chip and having at least one pumping part to circulate a refrigerant through a supply channel, a first circulation channel, a second circulation channel, and a discharge channel, the first and second circulation channels being formed in the head chip adjacent to and around the plurality of heaters for ink ejection, the first and second circulation channels and a portion of the supply channel and the discharge channel being formed in the channel forming layer, and another portion of the supply channel and the discharge channel being formed in the substrate.

18. The cartridge for an ink jet type image forming apparatus according to claim 17, further comprising:

the at least one pumping part provided in the cooling channel to forcibly circulate the refrigerant.

19. The cartridge for an ink jet type image forming apparatus according to claim 18, wherein each of the at least one pumping part includes a hot spot and a flow resistance portion provided downstream of flow of the hot spot.

20. A method of manufacturing a head chip for an ink jet type image forming apparatus, the method comprising:

preparing a substrate;

forming a plurality of heaters in a front surface of the substrate to heat ink;

forming a channel forming layer defining an ink channel and first and second circulation channels defining a closed-loop that is integrally formed in the head chip, is adjacent to and around the plurality of heaters, and has at least one pumping part to circulate a refrigerant through a supply channel, the first circulation channel, the second circulation channel, and a discharge channel, the first and second circulation channels being formed in the head chip adjacent to and around the plurality of heaters for ink ejection, the first and second circulation channels and a portion of the supply channel and the discharge channel being formed in the channel forming layer, and another portion of the supply channel and the discharge channel being formed in the substrate; and forming a nozzle layer having nozzles on the channel forming layer.

21. The method according to claim 20, further comprising:

forming the supply channel and the discharge channel in the substrate, the supply channel and the discharge channel being in contact with the first and second circulation channels.

22. The method according to claim 20, further comprising:

forming the at least one pumping part in at least one of the first and second circulation channels to forcibly circulate the refrigerant through the at least one of the first and second circulation channels.

23. An image forming apparatus comprising:

a feeding unit to feed a printing medium; and an image forming unit to form an image on the printing medium using a cartridge with a head chip, wherein the head chip comprises:

a substrate having an ink supply port for ink supply;

a plurality of nozzles to eject ink;

a channel forming layer disposed on the substrate to form ink channels between the ink supply port and the nozzles;

a plurality of heaters for ink ejection to apply heat to ink so that the ink is ejected through the plurality of nozzles; and a closed-loop cooling channel integrally formed in the head chip and having at least one pumping part to circulate a refrigerant through a supply channel, a first circulation channel, a second circulation channel, and a discharge channel, the first and second circulation channels being formed in the head chip adjacent to and around the plurality of heaters for ink ejection, the first and second circulation channels and a portion of the supply channel and the discharge channel being formed in the channel forming layer, and another portion of the supply channel and the discharge channel being formed in the substrate.

24. A cartridge usable with an image forming apparatus, the cartridge comprising:

an ink storage unit to store ink; and a head chip attached to a portion of the ink storage unit, wherein the head chip comprises:

a substrate having an ink supply port for ink supply;

a plurality of nozzles to eject ink;

a channel forming layer disposed on the substrate to form ink channels between the ink supply port and the nozzles;

a plurality of heaters for ink ejection to apply heat to ink so that the ink is ejected through the plurality of nozzles; and a closed-loop cooling channel integrally formed in the head chip and having at least one pumping part to circulate a refrigerant through a supply channel, a first circulation channel, a second circulation channel, and a discharge channel, the first and second circulation channels being formed in the head chip adjacent to and around the plurality of heaters for ink ejection, the first and second circulation channels and a portion of the supply channel and the discharge channel being formed in the channel forming layer, and another portion of the supply channel and the discharge channel being formed in the substrate.

* * * * *